US008984666B1

(12) United States Patent
LoBue

(10) Patent No.: US 8,984,666 B1
(45) Date of Patent: Mar. 24, 2015

(54) PROTECTIVE OUTER GARMENT APPARATUS WITH VIEWING WINDOW FOR HANDHELD ITEMS

(71) Applicant: Salvatore LoBue, San Clemente, CA (US)

(72) Inventor: Salvatore LoBue, San Clemente, CA (US)

( * ) Notice: Subject to any disclaimer, the term of this patent is extended or adjusted under 35 U.S.C. 154(b) by 0 days.

(21) Appl. No.: 14/200,024

(22) Filed: Mar. 7, 2014

Related U.S. Application Data

(60) Provisional application No. 61/911,469, filed on Dec. 4, 2013.

(51) Int. Cl.
*A41D 13/04* (2006.01)

(52) U.S. Cl.
USPC ..... 2/50

(58) Field of Classification Search
CPC ..... A41D 27/205; A41D 1/002
USPC ..... 2/87, 85, 247, 249, 250, 251, 252, 262
See application file for complete search history.

(56) References Cited

U.S. PATENT DOCUMENTS

| | | | | |
|---|---|---|---|---|
| 913,694 | A * | 3/1909 | Carpenter | 2/88 |
| 5,090,059 | A * | 2/1992 | Kahl | 2/104 |
| 5,848,439 | A * | 12/1998 | Huseth et al. | 2/104 |
| 6,279,162 | B1 * | 8/2001 | Silverthorn | 2/108 |
| 7,111,731 | B2 * | 9/2006 | Pratt et al. | 206/315.5 |
| 7,628,188 | B2 * | 12/2009 | Pratt et al. | 150/117 |
| 8,014,824 | B2 * | 9/2011 | Alden | 455/557 |
| 8,411,891 | B2 * | 4/2013 | Del Prete | 381/333 |
| 8,413,263 | B2 | 4/2013 | Crimi et al. | |
| 8,418,264 | B2 | 4/2013 | Alexander | |
| 2004/0154076 | A1 * | 8/2004 | Yoo | 2/247 |
| 2004/0237169 | A1 * | 12/2004 | Wood et al. | 2/94 |
| 2006/0062413 | A1 * | 3/2006 | Wehrell | 381/333 |
| 2010/0325767 | A1 | 12/2010 | Crimi et al. | |
| 2011/0252535 | A1 | 10/2011 | McNeil | |
| 2012/0185991 | A1 * | 7/2012 | Veytsman | 2/50 |

* cited by examiner

*Primary Examiner* — Khoa Huynh
*Assistant Examiner* — Anna Kinsaul
(74) *Attorney, Agent, or Firm* — John D. Tran; Rhema Law Group, P.C.

(57) ABSTRACT

A protective outer garment apparatus is disclosed which incorporates an at least one viewing window therein. Thus, as user is able to keep a handheld item positioned underneath or otherwise within an interior of the garment while still being able to safely view the item through the viewing window from an optimal viewing angle.

17 Claims, 6 Drawing Sheets

PROTECTIVE OUTER GARMENT APPARATUS WITH VIEWING WINDOW FOR HANDHELD ITEMS

RELATED APPLICATIONS

This application claims priority and is entitled to the filing date of U.S. provisional application Ser. No. 61/911,469, filed on Dec. 4, 2013 and entitled "Protective Outer-Garment Apparatus with Means for Viewing Items." The contents of the aforementioned application are incorporated by reference herein.

INCORPORATION BY REFERENCE

Applicant(s) hereby incorporate herein by reference any and all patents and published patent applications cited or referred to in this application.

BACKGROUND OF THE INVENTION

1. Field of the Invention

Aspects of this invention relate generally to protective garments, and more particularly to a protective outer garment apparatus incorporating an at least one viewing window therein for allowing the wearer to safely view a handheld item from an optimal viewing angle.

2. Description of Related Art

There are many types of protective coverings and outer garments available to protect one's clothes from unwanted or undesirable outside influences that may damage or negatively affect a person's body or clothing. Examples of such outer garments include ponchos, capes, cloaks, smocks, aprons, jackets, coats, and wearable blankets. A variety of unwanted or undesirable outside influences may include such things as dirt, hair, moisture, cold, chemicals, and other contaminates.

Although offering many protective advantages, such known outer garments all suffer from the limitation of preventing the wearer from gaining access to handheld items stored underneath said outer garments without exposing such items to the unwanted or undesirable outside influences. With the advent of technology, many people rely on or at least desire the ability to use personal electronic or non-electronic devices such as mobile phones, tablet computers, handheld gaming devices, books, and other similarly sized handheld items—many of which can be susceptible to dirt, moisture and other environmental elements.

Attempts have been made to remedy this problem by providing a protective outer garment, such as a barber cape, incorporating a basic cut-out in the center area of the garment with a transparent material spanning the cut-out, thereby forming a window in the garment for allowing the wearer to view their handheld items while keeping them underneath the outer garment. However, given the substantially vertical orientation of such windows, as positioned on an outer garment, relative to the wearer's face and line of sight, such solutions fail to provide or allow for the selective positioning or adjustability of such an outer garment window so that the handheld item may be safely viewed from an optimal viewing angle.

Aspects of the present invention fulfill these needs and provide further related advantages as described in the following summary.

SUMMARY OF THE INVENTION

Aspects of the present invention teach certain benefits in construction and use which give rise to the exemplary advantages described below.

The present invention solves the problems described above by providing a protective outer garment apparatus incorporating an at least one viewing window therein for allowing the wearer to safely view a handheld item from an optimal viewing angle. The apparatus provides, in at least one embodiment, an outer garment for being worn by a user. An outer surface of the garment provides an at least one cut-out sized and positioned for allowing an at least one handheld item positioned within an interior of the garment to be selectively extended therethrough by the user. An at least one viewing window is engaged with the outer surface of the garment, substantially overtop of the at least one cut-out, and provides a resilient window frame and a flexible, transparent window flap hingedly engaged with the window frame. The window flap is configured for moving between one of a closed window position, wherein the window flap is substantially positioned overtop of the cut-out, and an open window position, wherein the window flap is hingedly pivoted away from the window frame toward a face of the user. A pair of opposing, flexible side walls are integral with and extend between respective side edges of each of the window flap and window frame. Thus, the user is able to keep the handheld item positioned underneath or otherwise within the interior of the garment while still being able to view the item through the viewing window from an optimal viewing angle.

A primary objective inherent in the above described apparatus and method of use is to provide advantages not taught by the prior art.

Another objective is to provide such an apparatus that allows the wearer to safely view a handheld item from an optimal viewing angle while keeping the item positioned underneath the outer garment, in at least one embodiment.

Another objective is to provide such an apparatus that is relatively inexpensive to manufacture and capable of being manufactured in a wide variety of sizes and styles.

Another objective is to provide such an apparatus that is capable of being used in a variety of contexts and/or industries.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments.

DETAILED DESCRIPTION OF THE INVENTION

The above described drawing figures illustrate aspects of the invention in at least one of its exemplary embodiments, which are further defined in detail in the following description.

Figure 1:
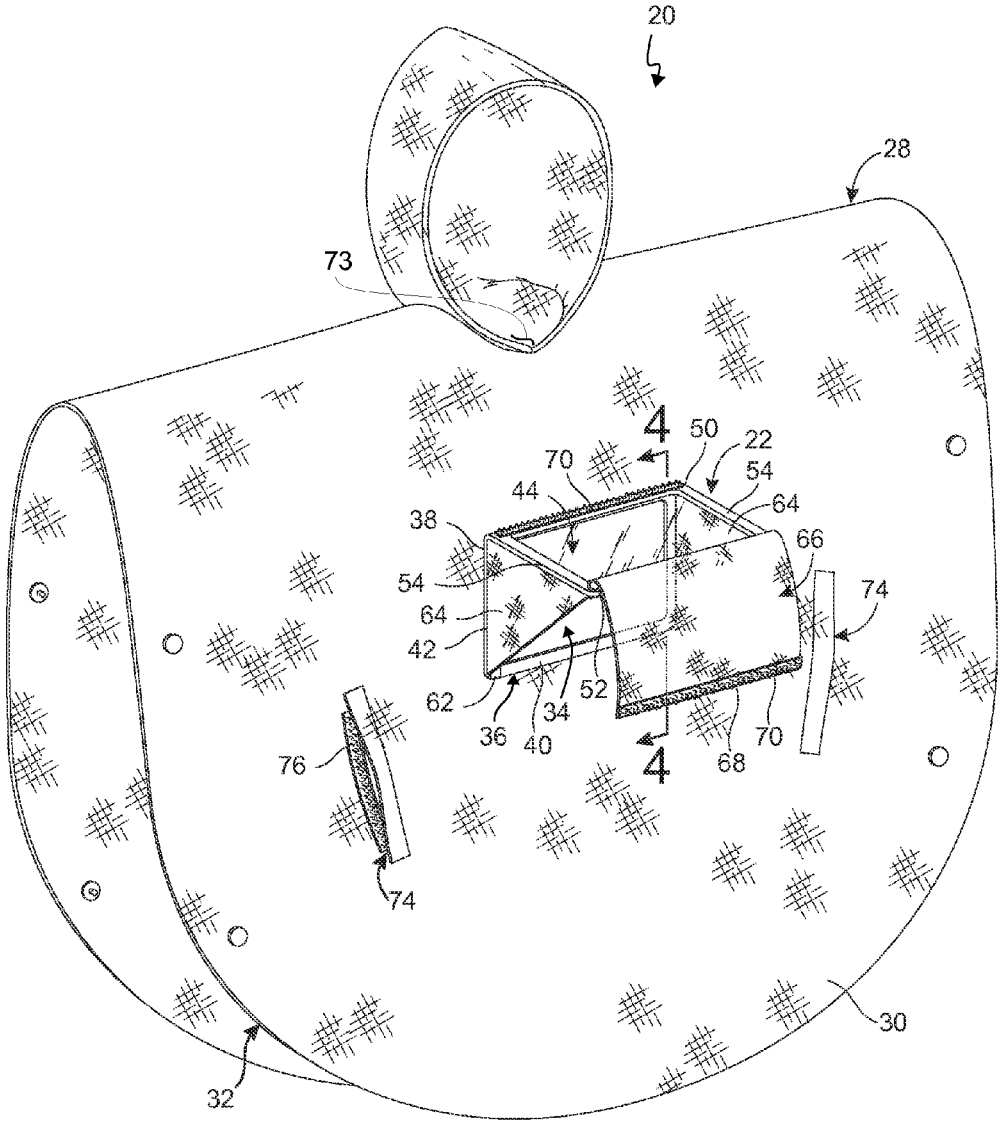
FIG. 1 is a perspective view of an exemplary outer garment apparatus, in 15 accordance with at least one embodiment.

Turning now to FIG. 1, there is shown a perspective view of an exemplary embodiment of a protective outer garment apparatus 20 incorporating an at least one viewing window 22 therein for allowing a wearer of the apparatus 20 (hereinafter referred to generally as a user 24) to safely view a handheld item 26—including but not limited to a mobile phone, tablet computer, music player, handheld gaming device, camera, book, etc. —from an optimal viewing angle. The apparatus 20 comprises, in at least one embodiment, an outer garment 28 for being worn by the user 24 and the viewing window 22 engaged with an outer surface 30 of the garment 28 and configured for allowing visual access into an interior 32 of the garment 28.

At the outset, it should be noted that the garments 28 shown in the drawings are merely exemplary and are shown simply for illustrative purposes. In further embodiments, the garment 28 may take on any other size, shape or style now known or later developed —such as a poncho, cape, cloak, smock, apron, jacket, coat, pants, skirt, shorts, wearable blanket, sleeping bag, etc. —so long as it is capable of substantially carrying out the functionality herein described. Furthermore, while the garment 28 is preferably constructed out of a durable waterproof and/or weatherproof material, such as nylon, polyester or plastic, it may be constructed out of any other material or combination of materials, now known or later developed. Similarly, the size, shape and position of the viewing window 22 as shown in the drawings is also merely exemplary and shown for illustrative purposes. Thus, in further embodiments, the viewing window 22 may take on any other size or shape now known or later conceived, and may be positioned anywhere on the outer surface 30 of the garment 28—dependent at least in part on the type of garment 28 and the type of item 26 to be viewed through the viewing window 22.

Figure 2:
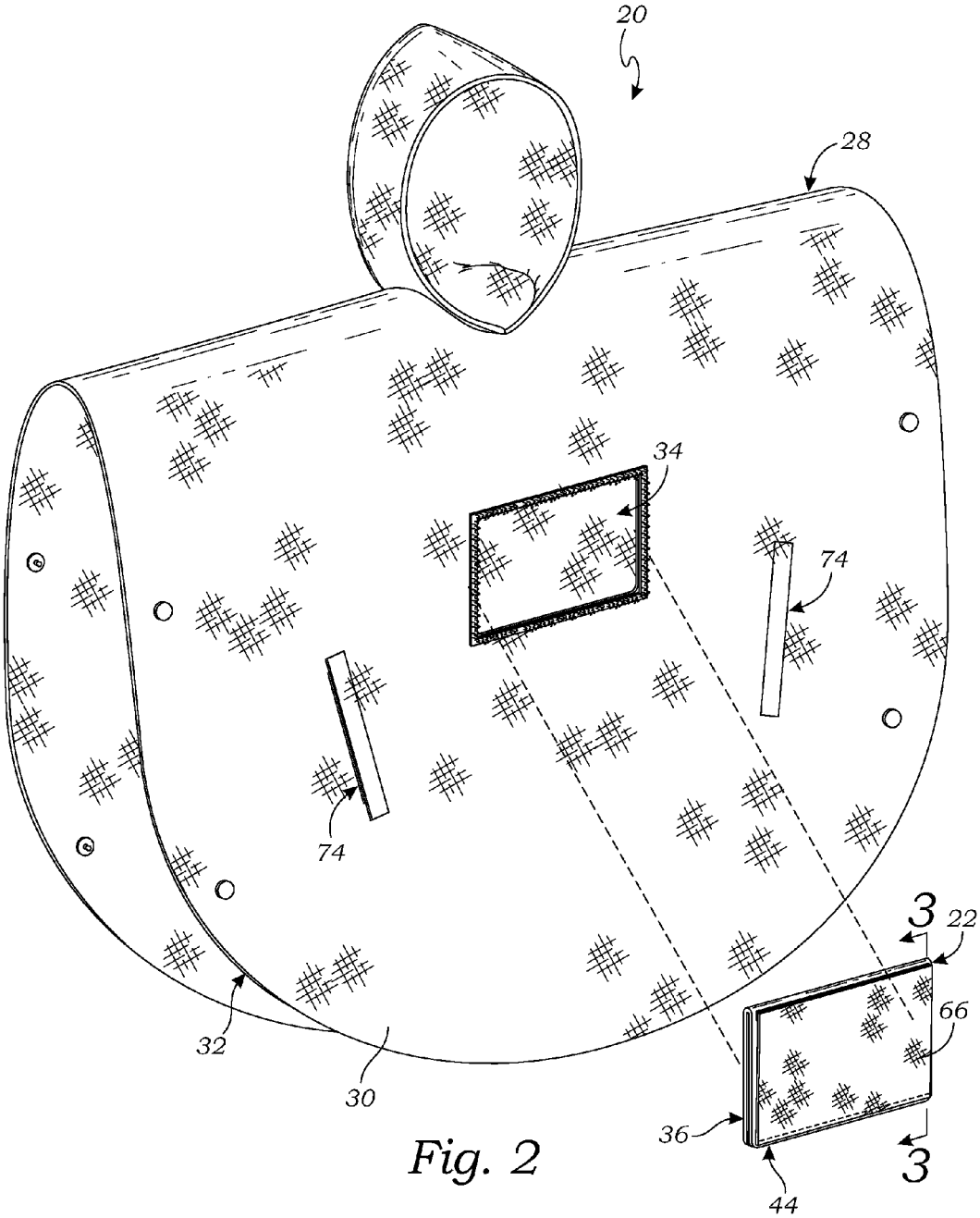
FIG. 2 is a partially exploded view thereof, in accordance with at least one embodiment.

As shown best in FIGS. 1 and 2, the garment 28 provides an at least one cut-out 34 sized and positioned for allowing visual access into the interior 32 of the garment 28. The cut-out 34 is also preferably sized for allowing the item 26 to at least partially extend therethrough, the purpose of which is discussed further below. The viewing window 22 is positioned overtop of the cut-out 34 and is engaged with the outer surface 30 of the garment 28. In at least one embodiment, the viewing window 22 is permanently affixed to the garment 28 by stitching, welding, or any other technique now known or later developed. In at least one alternate embodiment, discussed further below, the viewing window 22 is removably engagable with the garment 28 by snaps, hook and loop material, magnets, or any other technique now known or later developed.

In at least one embodiment, the viewing window 22 provides a relatively resilient window frame 36 engaged (or engagable) with the outer surface 30 of the garment 28. In the exemplary embodiment, the window frame 36 has a top edge 38, a bottom edge 40 and a pair of opposing side edges 42, with a central area of the window frame 36 being open and positioned substantially overtop of the cut-out 34 in the garment 28. The viewing window 22 further provides a relatively flexible, transparent window flap 44 hingedly engaged with the window frame 36 and configured for moving between one of a closed window position (FIG. 1)—wherein the window flap 44 is substantially in abutting contact with each of the top edge 38, bottom edge 40 and side edges 42 of the window frame 36 or is otherwise positioned overtop of the cut-out 34 in the garment 28 in an orientation substantially parallel with the outer surface 30 of the garment 28—and an open window position (FIG. 2)—wherein the window flap 44 is hingedly pivoted away from the window frame 36 (i.e., toward a face 46 of the user 24) such that a window angle 48 between the window flap 44 and the window frame 36 (or cut-out 34) is greater than zero degrees and less than one hundred eighty degrees. In the exemplary embodiment, the window angle 48 is preferably between thirty and ninety degrees when the window flap 44 is in the open window position. In this way, the window flap 44 provides an optimal viewing angle for the user 24 to view and manipulate the item 26 while it is still being protected by the viewing window 22 and garment 28. In other words, because the window flap 44 is capable of being opened and moved into to a roughly horizontal orientation (or substantially perpendicular to the cut-out 34 of the garment 28), the window flap 44 is able to create a transparent protective "roof" under which the item 26 may be positioned as the item 26 extends a distance through the cut-out 34 of the garment 28. In further such embodiments, the viewing window 22 is configured for allowing the user 24 to selectively adjust the window angle 48 for when the window flap 44 is in the open window position. Similar to the window frame 36, the window flap 44 has a top edge 50, a bottom edge 52, and a pair of opposing side edges 54. Additionally, in the exemplary embodiment, the window flap 44 is preferably sized and configured for spanning the entire area between the top edge 38, bottom edge 40 and side edges 42 of the window frame 36, thereby effectively covering the cut-out 34 in the garment 28 when in the closed window position. As shown in FIG. 2, in at least one embodiment, the window flap 44 is hingedly engaged with the top edge 38 of the window frame 36. However, in alternate embodiments, the window flap 44 may be hingedly engaged with any of the bottom edge 40 or side edges 42 of the window frame 36. In still further embodiments, the window frame 36 may be omitted altogether, such that the window flap 44 is simply hingedly engaged with the outer surface 30 of the garment 28. It should be noted that in such further embodiments, each of the components discussed below as being incorporated on or within the window frame 36 are instead incorporated on or within the garment 28 itself.

In at least one embodiment, the window flap 44 is biased toward the open window position such that an at least one hand 56 of the user 24 is free to hold and manipulate the item 26 without also having to manually hold the window flap 44 in the open window position. In one such embodiment, shown in the cross-sectional views of FIGS. 3 and 4, this biasing is achieved through a pair of resilient, substantially V-shaped biasing members 58 positioned within or otherwise integral with each side edge 42 of the window frame 36 and corresponding side edge 54 of the window flap 44. Each biasing member 58 is preferably constructed of plastic. However, in alternate embodiments, the biasing members 58 may be constructed of any other material (such as metal) or combination of materials, now known or later developed, so long as they are capable of substantially carrying out the functionality herein described. In an alternate embodiment, shown in FIG. 5, the biasing of the window flap 44 is achieved through an at least one spring hinge 60 engaged between each of the window flap 44 and window frame 36. In at least one such embodiment, the spring hinge 60 is configured for floating between the window flap 44 and window frame 36, thereby allowing for expansion between the window flap 44 and window frame 36 when moving between the closed and open window positions. In still further embodiments, the biasing of the window flap 44 may be achieved using any other mechanism, or combination of mechanisms, now known or later developed, capable of allowing the window flap 44 to substantially carry out the functionality herein described.

Figure 3:
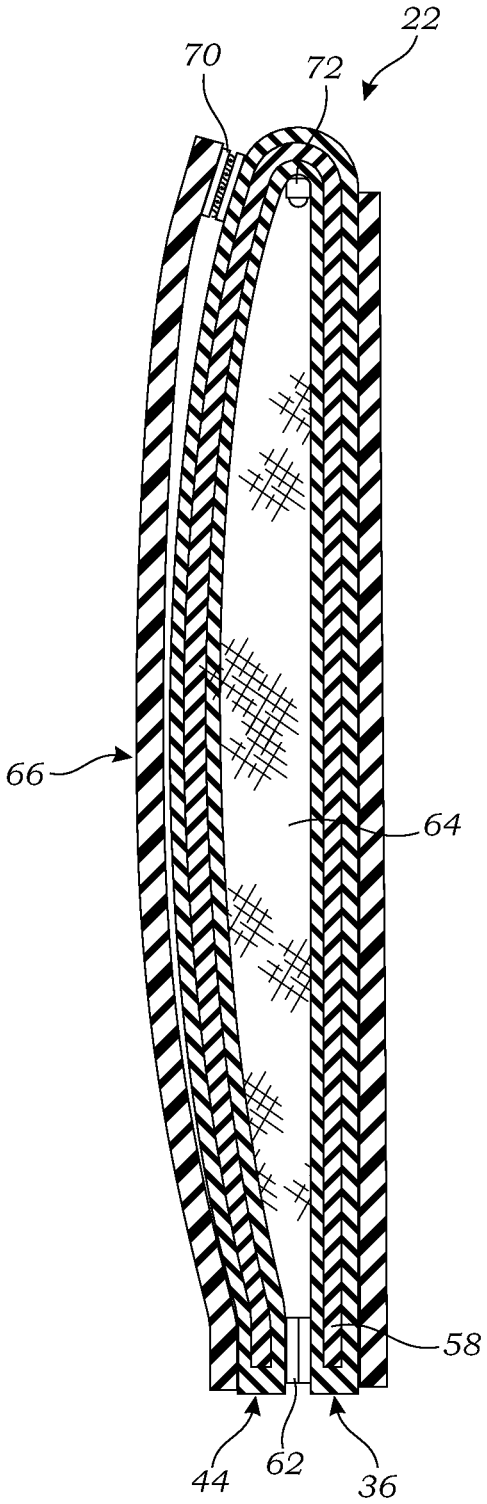
FIG. 3 is a cross-sectional view taken along line 3-3 in FIG. 2, in accordance with at least one embodiment.
Figure 4:
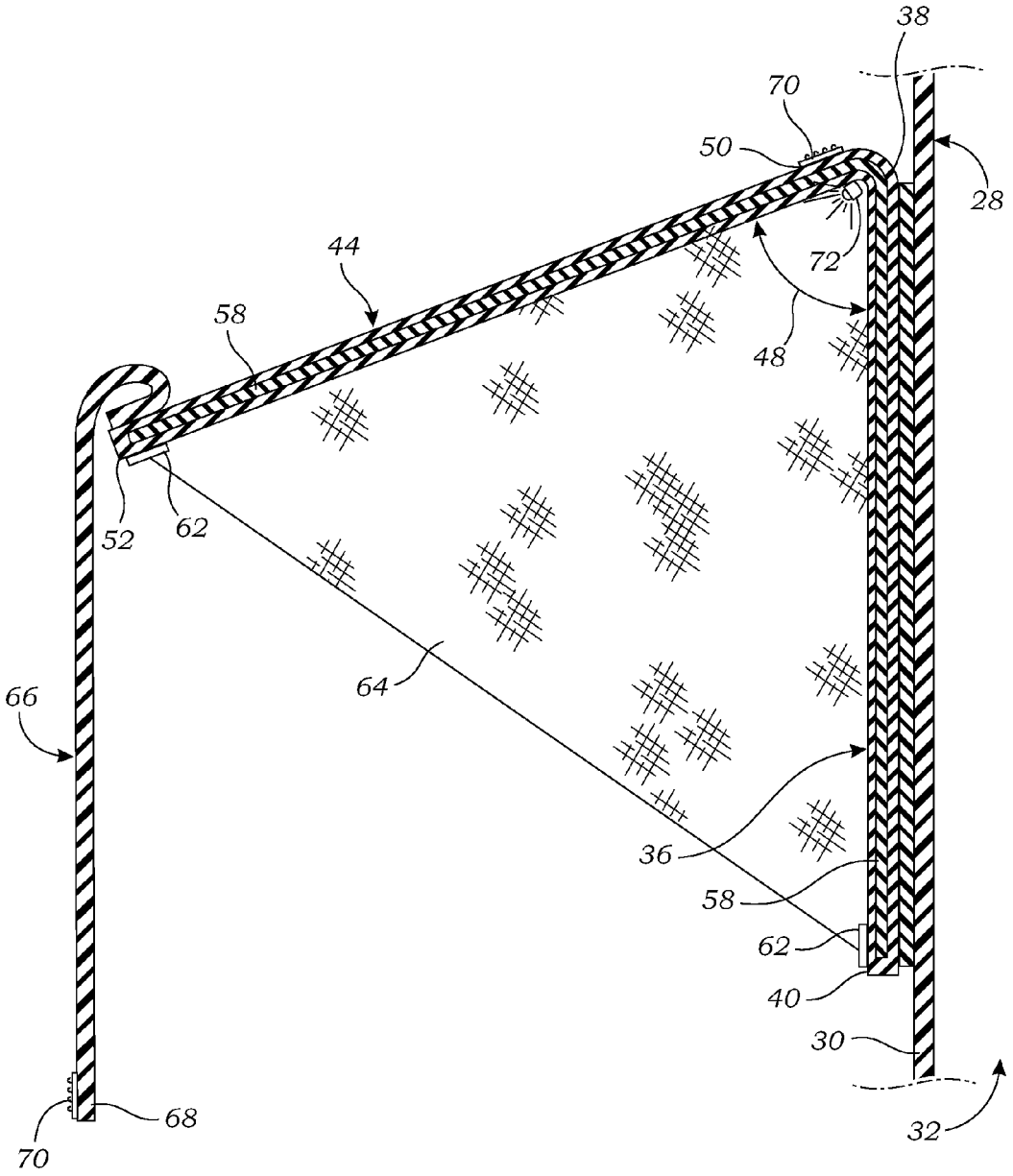
FIG. 4 is a partial cross-sectional view taken along line 4-4 in FIG. 1, in accordance with at least one embodiment.
Figure 5:
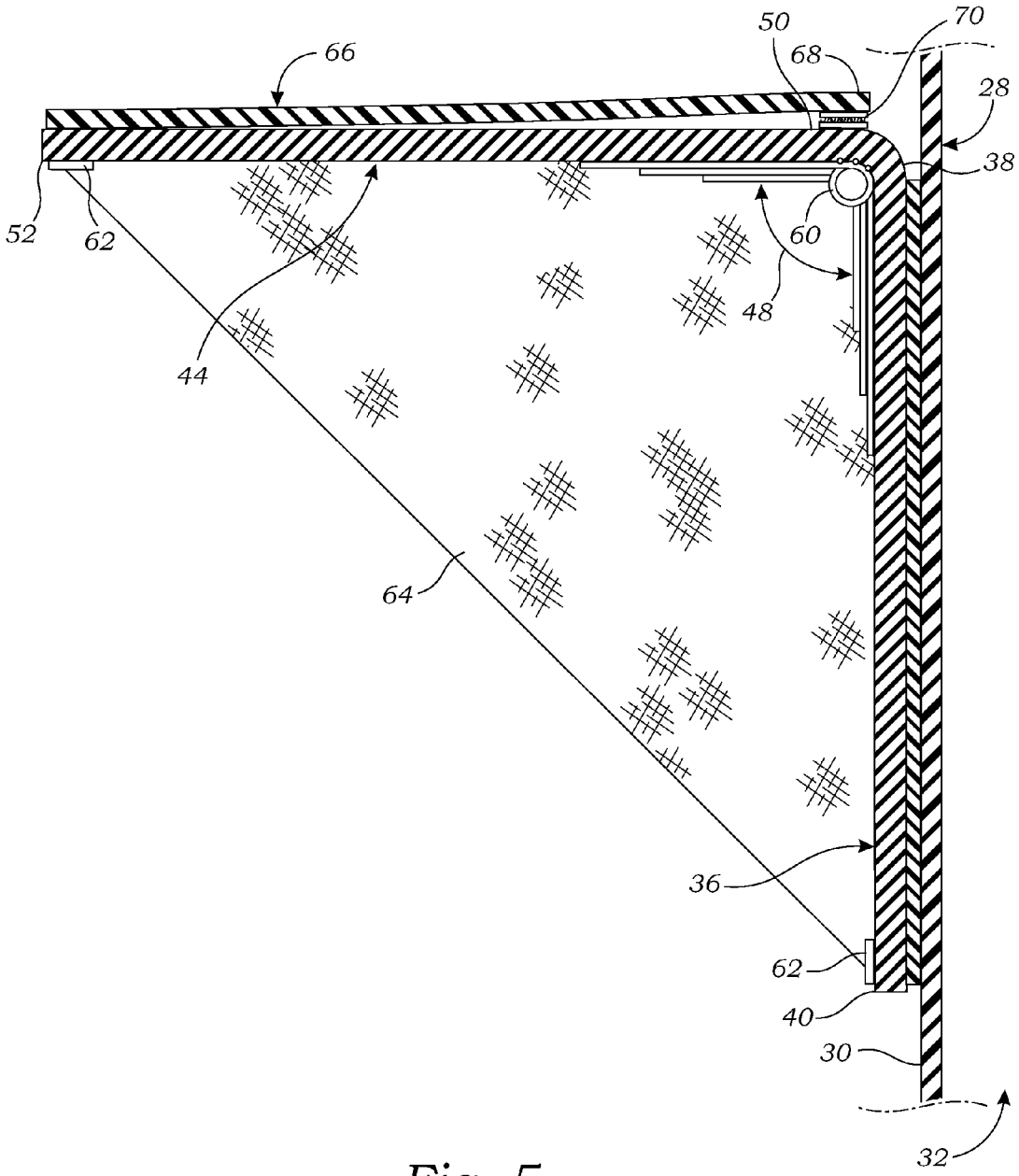
FIG. 5 is an alternate partial cross-sectional view of FIG. 4, showing an alternative exemplary viewing window, in accordance with at least one embodiment.

In at least one embodiment, as best shown in FIGS. 3 and 4, where the window flap 44 is biased toward the open window position, an at least one free edge 52 and 54 of the window flap 44 provides an at least one attachment point 62 configured for removably securing the window flap 44 to the at least one corresponding edge 40 and 42 of the window frame 36 when the window flap 44 is in the closed window position, thereby preventing the window flap 44 from unintentionally moving out of the closed window position. In at least one such embodiment, the attachment point 62 is a button or snap. In another such embodiment, the attachment point 62 is a pair of magnets. In another such embodiment, the attachment point 62 is hook and loop material. In still further embodiments, the attachment point 62 may comprise any other temporary fastening or removable engagement means, now known or later developed, strong enough to resist and overcome the biasing forces that urge the window flap 44 into the open window position. As illustrated in FIG. 3, in at least one embodiment, the biasing of the window flap 44 toward the open window position causes the window flap 44 to slightly bow when locked in the closed window position—i.e., the side edges 54 of the window flap 44 are not in complete abutting contact with the side edges 42 of the window frame 36. This allows the item 26 to be extended a distance through the cut-out 34 and into the viewing window 22, even when the window flap 44 is in the closed window position.

In at least one embodiment, as best shown in FIGS. 3 and 4, the viewing window 22 further provides a pair of opposing, flexible side walls 64, each side wall 64 integral with and extending between the respective side edge 54 and 42 of each of the window flap 44 and window frame 36. Thus, when the window flap 44 is in the closed window position, a weatherproof seal is created about an entire perimeter of the window frame 36 and, thus, the cut-out 34 of the garment 28. Additionally, when the window flap 44 is in the open window position, the side walls 64 provide further protection to the item 26 when the item is positioned within the viewing window 22. In one such embodiment, the side walls 64 are constructed out of the same material as the garment 28 itself, so as to be more aesthetically pleasing. However, in alternate embodiments, the side walls 64 may be constructed out of any other material or combination of materials, now known or later developed. In at least one alternate embodiment, where the window frame 44 is omitted altogether, each side wall 64 is integral with and extends between one of the side edges 54 of the window flap 44 and the outer surface 30 of the garment 28.

Figure 1A:
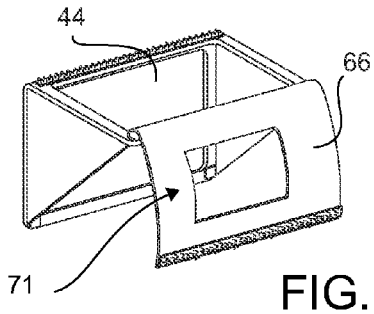
FIG. 1A is a perspective view of the viewing window of FIG. 1 in an alternative embodiment.

In at least one embodiment, as best shown in FIGS. 3 and 4, the viewing window 22 further provides a cover flap 66 hingedly engaged with the bottom edge 52 of the window flap 44 and configured for moving between one of a closed cover position (FIG. 3)—wherein a top edge 68 of the cover flap 66 is removably engaged with the top edge 50 of the window flap 44, thus covering the window flap 44—and an open cover position (FIG. 4)—wherein the cover flap 66 is hingedly pivoted down and away from the window flap 44 such that the window flap 44 is substantially uncovered. Additionally, the top edge 68 of the cover flap 66 provides an at least one attachment point 70 configured for removably securing the cover flap 66 to the window flap 44 when the cover flap 66 is in the closed cover position, thereby preventing the cover flap 66 from unintentionally moving out of the closed cover position. In at least one such embodiment, the attachment point 70 is a button or snap. In another such embodiment, the attachment point 70 is a pair of magnets. In another such embodiment, the attachment point 70 is hook and loop material. In still further embodiments, the attachment point 70 may comprise any other temporary fastening or removable engagement means, now known or later developed, capable of allowing the cover flap 66 to substantially carry out the functionality herein described. In the exemplary embodiment, the cover flap 66 has substantially the same dimensions as the window flap 44. Thus, when the viewing window 22 is not in use, the cover flap 66 may be manually moved to the closed cover position so as to cover/hide the window flap 44. As such, in the exemplary embodiment, the cover flap 66 is constructed out of the same material as the garment 28 itself, so as to be more aesthetically pleasing. However, in alternate embodiments, the cover flap 66 may be constructed out of any other non-transparent material or combination of materials, now known or later developed. In still further embodiments, as exemplified by FIG. 1A, the cover flap 66 provides a central opening 71 therethrough, allowing visual access through a portion of the window flap 44 even when the cover flap 66 is in the closed cover position. Such a central opening effectively creates a porthole (though could be a shape other than circular), which can be beneficial to the user 24 when the item 26 positioned underneath the garment 28 is a camera or camcorder, as the user 24 is then able to capture photos or video through the viewing window 22 even when the window flap 44 is in the closed window position and the cover flap 66 is in the closed cover position.

In at least one embodiment, as shown best in FIGS. 2 and 4, the viewing window 22 further provides an at least one light 72 positioned underneath the window flap 44, within the window frame 36, for selectively illuminating the item 26 positioned within the viewing window 22 at night or in low-light conditions where it may otherwise be difficult for the user 24 to view the item 26. In the exemplary embodiment, the light 72 is configured for automatically turning on when the window flap 44 is in the open window position, and automatically turning off when the window flap 44 is in the closed window position. In further embodiments, any other means for or method of manually or automatically turning the light 72 on and off, now known or later developed, may be substituted.

As mentioned above, in at least one embodiment, the viewing window 22 is removably engagable with the outer surface 30 of the garment 28. In at least one such embodiment, the garment 28 is capable of removably receiving viewing windows 22 of varying shapes and sizes, such that the user 24 is able to selectively interchange various viewing windows 22 with a single garment 28 or with multiple garments 28. In at least one further embodiment, not shown, the garment 28 provides two or more cut-outs 34 positioned on different locations on the garment 28 such that the user 24 may selectively engage the viewing windows 22 overtop of whichever cut-outs 34 are most convenient. For example, a particular right-handed user 24 might find that a cut-out 34 on a left side of the garment 28 is the most comfortable to use. Thus, such a garment 28 is able to be utilized by a wider range of users 24. In at least one such embodiment, not shown, each of the cut-outs 34 provides a closure configured for temporarily sealing the cut-out 34 when not in use (i.e., when the viewing window 22 is not positioned overtop of said cut-out 34), in order to prevent unwanted environmental elements from entering the interior 32 of the garment 28. In one such embodiment, the closure is a zipper. In another such embodiment, the closure is one or more buttons or snaps. In another such embodiment, the closure is hook and loop material. In still further such embodiments, the closure may be any other temporary fastening or sealing means, now known or later developed.

In FIG. 1, the garment 28 provides an at least one wire clip 73 positioned proximal a neck aperture of the garment 28 and configured for removably receiving a wire of a pair of headphones, earphones or the like, where such an audio peripheral is interconnected with the item 26.

Figure 6:
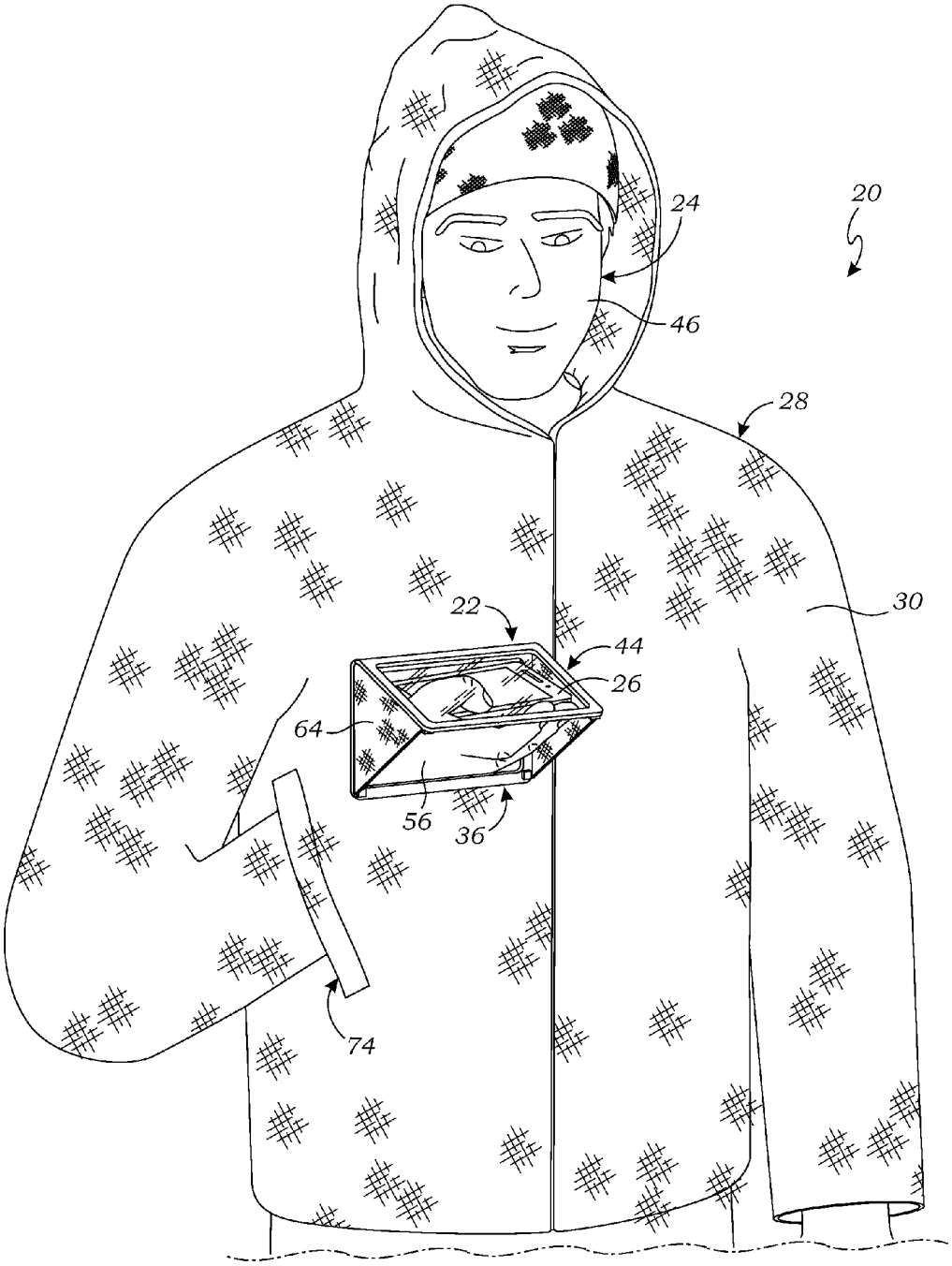
FIG. 6 is a partial perspective view of the exemplary outer garment apparatus as worn by a user, in accordance with at least one embodiment.

Referring now to FIGS. 1 and 6, in at least one embodiment, the garment 28 provides an at least one access slot 74 sized and configured for allowing the user 24 to reach their hand 56 into the interior 32 of the garment 28 for holding and manipulating the item 26 therewithin. In at least one such embodiment, each access slot 74 provides a closure 76 configured for temporarily sealing the access slot 74 when not in use, in order to prevent unwanted environmental elements from entering the interior 32 of the garment 28. In one such embodiment, the closure 76 is a zipper. In another such embodiment, the closure 76 is one or more buttons or snaps. In another such embodiment, the closure 76 is hook and loop material. In still further such embodiments, the closure 76 may be any other temporary fastening or sealing means, now known or later developed.

Thus, as illustrated in FIG. 6, the user 24 is able to keep the handheld item 26 positioned underneath or otherwise within the interior 32 of the garment 28 (to protect it from unwanted environmental elements) while still being able to view and manipulate the item 26 by viewing it through the viewing window 22 from an optimal viewing angle. When the window flap 44 is in the open window position, the user 24 even has the ability to move the item 26 closer to their face 46 in order to more comfortably view the item 26 while still being protected by the viewing window 22 and garment 28.

To summarize, regarding the exemplary embodiments of the present invention as shown and described herein, it will be appreciated that a protective outer garment apparatus incorporating an at least one viewing window therein is disclosed and configured for allowing the wearer to safely view a handheld item from an optimal viewing angle. Because the principles of the invention may be practiced in a number of configurations beyond those shown and described, it is to be understood that the invention is not in any way limited by the exemplary embodiments, but is generally directed to a protective outer garment with an at least one viewing window and is able to take numerous forms to do so without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention. Furthermore, the various features of each of the above-described embodiments may be combined in any logical manner and are intended to be included within the scope of the present invention.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A protective outer garment apparatus comprising:

an outer garment for being worn by a user, an outer surface of the garment providing an at least one cut-out sized and positioned for allowing an at least one handheld item positioned within an interior of the garment to be selectively extended therethrough by the user; and an at least one viewing window engaged with the outer surface of the garment substantially overtop of the at least one cut-out, the viewing window comprising:

a resilient window frame engaged with the outer surface of the garment and having a top edge, a bottom edge and a pair of opposing side edges, with a central area of the window frame being open and positioned substantially overtop of the cut-out;

a flexible, transparent window flap hingedly engaged with the window frame and having a top edge, a bottom edge and a pair of opposing side edges, the window flap configured for moving between one of a closed window position, wherein the window flap is substantially positioned overtop of the cut-out, and an open window position, wherein the window flap is hingedly pivoted away from the window frame toward a face of the user such that a window angle between the window flap and window frame is greater than zero degrees and less than one hundred eighty degrees, and the transparent window flap is biased toward the open window position;

a pair of resilient, substantially V-shaped biasing members positioned within or otherwise integral with each side edge of the window frame and a corresponding side edge of the window flap;

an at least one spring hinge engaged between each of the window flap and window frame; and a pair of opposing, flexible side walls, each side wall integral with and extending between the respective side edge of each of the window flap and window frame; and whereby, the user is able to keep the handheld item positioned underneath or otherwise within the interior of the garment while still being able to safely view the item through the viewing window from an optimal viewing angle.

2. The protective outer garment apparatus of claim 1, wherein the at least one viewing window is permanently affixed to the outer surface of the garment.

3. The protective outer garment apparatus of claim 1, wherein the at least one viewing window is removably engagable with the outer surface of the garment.

4. The protective outer garment apparatus of claim 1, wherein the window angle is between thirty and ninety degrees when the window flap is in the open window position.

5. The protective outer garment apparatus of claim 1, wherein the viewing window is configured for allowing the user to selectively adjust the window angle.

6. The protective outer garment apparatus of claim 1, wherein the window flap is hingedly engaged with the top edge of the window frame.

7. The protective outer garment apparatus of claim 1 wherein the spring hinge configured to allow for expansion between the window flap and window frame when the window flap moves between the closed and open window positions.

8. The protective outer garment apparatus of claim 1 wherein the bottom edge of the window flap provides an at least one attachment point configured for removably securing the window flap to the bottom edge of the window frame when the window flap is in the closed window position.

9. The protective outer garment apparatus of claim 1, wherein the viewing window further provides a cover flap hingedly engaged with the bottom edge of the window flap and configured for moving between one of a closed cover position, wherein a top edge of the cover flap is removably engaged with the top edge of the window flap for covering the window flap, and an open cover position, wherein the cover flap is hingedly pivoted down and away from the window flap such that the window flap is substantially uncovered.

10. The protective outer garment apparatus of claim 9, wherein the top edge of the cover flap provides an at least one attachment point configured for removably securing the cover flap to the window flap when the cover flap is in the closed cover position.

11. The protective outer garment apparatus of claim 10, wherein the cover flap provides a central opening therethrough, allowing visual access through a portion of the window flap even when the cover flap is in the closed cover position.

12. The protective outer garment apparatus of claim 1, wherein the viewing window further provides an at least one light positioned underneath the window flap, within the window frame, for selectively illuminating the item positioned within the viewing window.

13. The protective outer garment apparatus of claim 1, wherein the garment provides an at least one access slot sized and configured for allowing the user to reach their hand into the interior of the garment for holding and manipulating the item therewithin.

14. The protective outer garment apparatus of claim 13, wherein the at least one access slot provides a closure configured for temporarily closing off the access slot when not in use, in order to prevent unwanted environmental elements from entering the interior of the garment.

15. The protective outer garment apparatus of claim 1, wherein the garment further provides an at least one wire clip positioned proximal a neck aperture of the garment and configured for removably receiving a wire of an audio peripheral that is interconnected with the item.

16. A protective outer garment apparatus comprising:

an outer garment for being worn by a user, an outer surface of the garment providing an at least one cut-out sized and positioned for allowing an at least one handheld item positioned within an interior of the garment to be selectively extended therethrough by the user; and an at least one viewing window engaged with the outer surface of the garment substantially overtop of the at least one cut-out, the viewing window comprising:

a resilient window frame engaged with the outer surface of the garment and having a top edge, a bottom edge and a pair of opposing side edges, with a central area of the window frame being open and positioned substantially overtop of the cut-out;

a flexible, transparent window flap hingedly engaged with the top edge of the window frame and having a top edge, a bottom edge and a pair of opposing side edges, the window flap configured for moving between one of a closed window position, wherein the window flap is substantially positioned overtop of the cut-out, and an open window position, wherein the window flap is hingedly pivoted away from the window frame toward a face of the user such that a window angle between the window frame and window flap is greater than zero degrees and less than one hundred eighty degrees;

the window flap being biased toward the open window position, with the bottom edge of the window flap providing an at least one attachment point configured for removably securing the window flap to the bottom edge of the window frame when the window flap is in the closed window position;

a pair of resilient, substantially V-shaped biasing members positioned within or otherwise integral with each side edge of the window frame and a corresponding side edge of the window flap;

an at least one spring hinge engaged between each of the window flap and window frame;

a pair of opposing, flexible side walls, each side wall integral with and extending between the respective side edge of each of the window flap and window frame; and whereby, the user is able to keep the handheld item positioned underneath or otherwise within the interior of the garment while still being able to safely view the item through the viewing window from an optimal viewing angle.

17. A protective outer garment apparatus comprising:

an outer garment for being worn by a user, an outer surface of the garment providing an at least one cut-out sized and positioned for allowing an at least one handheld item positioned within an interior of the garment to be selectively extended therethrough by the user;

a flexible, transparent window flap hingedly engaged with the outer surface of the garment, substantially overtop of the at least one cut-out, and having a top edge, a bottom edge and a pair of opposing side edges, the window flap configured for moving between one of a closed window position, wherein the window flap is substantially positioned overtop of the cut-out, and an open window position, wherein the window flap is hingedly pivoted away from the cut-out toward a face of the user such that a window angle between the window flap and cut-out is greater than zero degrees and less than one hundred eighty degrees, and the transparent window flap is biased toward the open window position;

a pair of resilient, substantially V-shaped biasing members positioned within or otherwise integral with each side edge of the window frame and a corresponding side edge of the window flap;

an at least one spring hinge engaged between each of the window flap and window frame;

a pair of opposing, flexible side walls, each side wall integral with and extending between one of the side edges of the window flap and the outer surface of the garment; and whereby, the user is able to keep the handheld item positioned underneath or otherwise within the interior of the garment while still being able to safely view the item through the window flap from an optimal viewing angle.

* * * * *